US010429007B2

(12) United States Patent
Yang et al.

(10) Patent No.: US 10,429,007 B2
(45) **Date of Patent: *Oct. 1, 2019**

(54) GAS PRESSURE TANK STRUCTURE

(71) Applicant: Amsted Rail Company, Inc., Chicago, IL (US)

(72) Inventors: Zhaoli Yang, Xinyang (CN); Yue Zuo, Chicago, IL (US); Xuejun Zhu, Datong (CN); Sijin Zhang, Xinyang (CN); Chengqun Yan, Xinyang (CN); Zhongxian Du, Xinyang (CN); Jianfei Sun, Harbin (CN); Fuyang Cao, Harbin (CN); Dongye Yang, Harbin (CN)

(73) Assignee: Amsted Rail Company, Inc., Chicago, IL (US)

( * ) Notice: Subject to any disclaimer, the term of this patent is extended or adjusted under 35 U.S.C. 154(b) by 301 days.

This patent is subject to a terminal disclaimer.

(21) Appl. No.: 15/407,000

(22) Filed: Jan. 16, 2017

(65) Prior Publication Data

US 2017/0198862 A1 Jul. 13, 2017

(30) Foreign Application Priority Data

Jan. 10, 2016 (CN) ..... 2016 2 0016148 U

(51) Int. Cl.

| | |
|---|---|
| ***F17C 1/02*** | (2006.01) |
| ***C21C 7/00*** | (2006.01) |
| ***C21C 5/46*** | (2006.01) |
| ***F27D 1/00*** | (2006.01) |

(52) U.S. Cl.

CPC ..... *F17C 1/02* (2013.01); *C21C 5/46* (2013.01); *C21C 7/00* (2013.01); *F27D 1/00* (2013.01); *F17C 2201/0109* (2013.01); *F17C 2203/012* (2013.01); *F17C 2203/066* (2013.01); *F17C 2203/0639* (2013.01); *F17C 2227/0157* (2013.01); *F17C 2260/01* (2013.01)

(58) Field of Classification Search

CPC .... F17C 1/02; F17C 2201/0109; F17C 13/08; B22D 41/06; B22D 17/32; B22D 37/00; B22D 39/00; B22D 41/04; B22D 17/2015; B22D 13/107

See application file for complete search history.

(56) References Cited

U.S. PATENT DOCUMENTS

| | | | | |
|---|---|---|---|---|
| 3,419,180 A * | 12/1968 | Homrig | F16J 13/12 | 220/235 |
| 7,971,852 B2 * | 7/2011 | Otsubo | F16L 55/1108 | 220/581 |
| 8,231,028 B2 * | 7/2012 | Matsuoka | F16J 13/12 | 220/582 |
| 2003/0189053 A1 * | 10/2003 | Felbaum | F17C 1/02 | 220/582 |

* cited by examiner

*Primary Examiner* — Anthony D Stashick
*Assistant Examiner* — Blaine G Neway
(74) *Attorney, Agent, or Firm* — Harness, Dickey & Pierce, P.L.C.

(57) ABSTRACT

A gas pressure tank structure including: a tank wall, a compression oil cylinder, a locking ring, a spring cylinder, a locating pin mounting hole, a dowel pinhole, a refractory brick, a guide mechanism, a sealing structure, an arc joint, an arc shaped tank bottom, a steel ladle stand, a tank cover, and a reinforcing board.

3 Claims, 1 Drawing Sheet

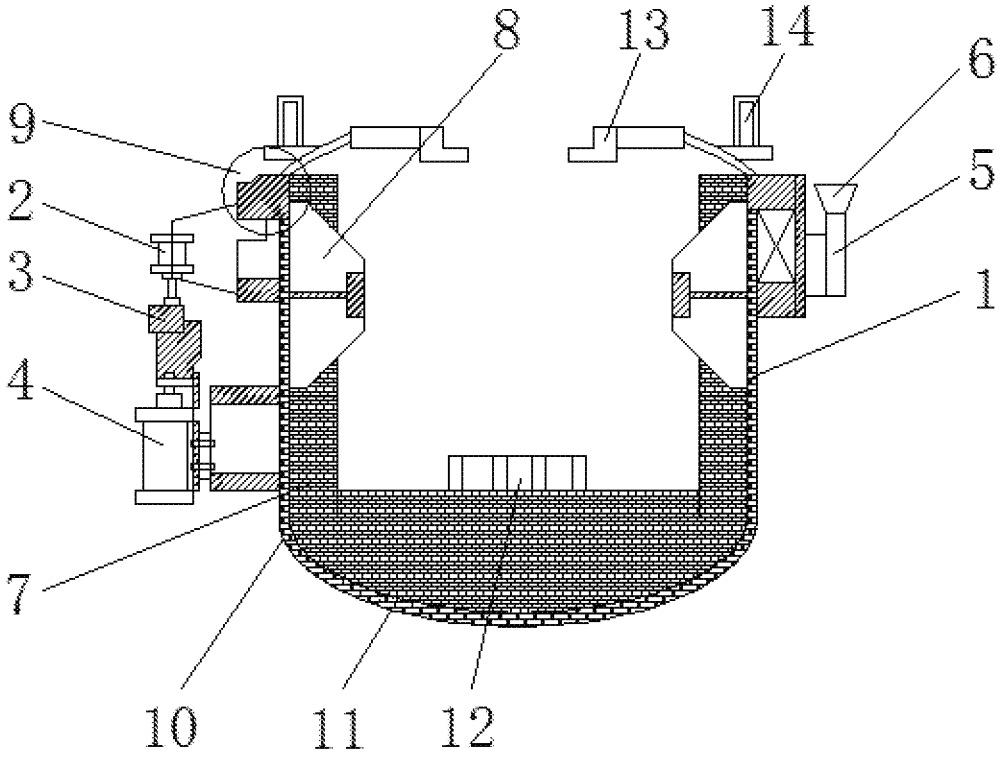
8
13
14
6
9
5
2
3
1
4
7
10
11
12

GAS PRESSURE TANK STRUCTURE

CROSS-REFERENCE TO RELATED APPLICATION

This application claims the benefit and priority of Chinese Patent Application Serial No. 201620016148.9 filed Jan. 10, 2016, the entire disclosure of which is incorporated herein by reference.

FIELD

The present invention relates to the field of gas pressure tank structures, and specifically to a gas pressure tank structure.

BACKGROUND

This section provides background information related to the present disclosure which is not necessarily prior art.

Currently, manufacturers for cast steel wheels generally use gravity pouring process for production.

SUMMARY

This section provides a general summary of the disclosure, and is not a comprehensive disclosure of its full scope or all of its features.

In order to improve product quality, the Applicant made technological research and development for the pressure pouring technology wherein a 25t steel ladle is put in a gas pressure tank; the gas pressure tank is closed and locked by the cover thereof and is filled with compressed air; under the action of such gas pressure, the liquid steel in the steel ladle flows via the pouring passage into the graphite mold cavity, thus performing pouring processing therein. Such production processing is based on the designs of the gas pressure tank and its locking structure. The locking structure for the gas pressure tank has been patented. The present patent application relates only to the invention designs of the pressure tank and the tank cover.

The objective of the present invention is to provide a gas pressure tank structure, so as to solve the problem(s) as mentioned in the above background technology.

In order to achieve the above objective, a technical solution is provided in the present invention as follows: a gas pressure tank structure, comprising: a tank wall, a compression oil cylinder, a locking ring, a spring cylinder, a locating pin mounting hole, a dowel pinhole, a refractory brick, a guide mechanism, a sealing structure, an arc joint, an arc shaped tank bottom, a steel ladle stand, a tank cover, a reinforcing board, wherein the tank wall is provided on its left side with the compression oil cylinder, the compression oil cylinder is provided on its lower side with the locking ring, the locking ring is provided on its lower side with the spring cylinder, the tank wall is provided on its right side with the locating pin mounting hole, the locating pin mounting hole is provided thereon with the dowel pinhole, the tank wall is provided therein with the refractory brick and the guide mechanism, the tank wall is provided at its upper end with the sealing structure and is provided at its lower side with the arc joint, the arc joint is connected with the arc shaped tank bottom, the refractory brick is provided thereon with the steel ladle stand, and the tank wall is provided thereon with the tank cover.

Preferably, the tank wall is welded by rolled 15 mm thick steel plate.

Preferably, the sealing structure is formed by a high temperature resistant silicone rubber sealing strip.

Preferably, the arc joint has a radian of R0.165, and the arc shaped tank bottom has a radian of R2.565.

Preferably, the tank cover is consistent, in the structure basis, with the tank wall, and is further provided with 24 reinforcing boards.

Compared with the prior art, the present invention may have the following beneficial effects: in the structure, the pressure tank and tank cover have enough strength to ensure that they will not deform at high temperature and under high pressure; a good sealing between the pressure tank and tank cover is provided to ensure that there is no gas leakage in pressure pouring; when the tank cover is closed onto the pressure tank, the space between them and the steel ladle is relatively small, thus can reduce the consumption of compressed air and increase the response speed of the pouring pressure curve during pouring.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a front view of the gas pressure tank structure with a cutaway of the tank wall according to an embodiment of the present invention.

Corresponding reference numerals indicate corresponding parts throughout the several views of the drawings.

DETAILED DESCRIPTION

Example embodiments will now be described more fully with reference to the accompanying drawings.

Hereinafter, the technical solutions in the embodiments of the present invention will be described clearly and completely, in connection with the accompanying drawings in the embodiments of the present invention. The described embodiments are only example embodiments of the present invention, not all the possible embodiments. Any other embodiments obtained by those skilled in the art, based on the embodiment of the present invention and without any inventive work, will fall within the protection scope of the present invention.

Referring to FIG. 1, in the present invention, a technical solution is described as follows: a gas pressure tank structure, includes a tank wall 1, a compression oil cylinder 2, a locking ring 3, a spring cylinder 4, a locating pin mounting hole 5, a dowel pinhole 6, a refractory brick 7, a guide mechanism 8, a sealing structure 9, an arc joint 10, an arc shaped tank bottom 11, a steel ladle stand 12, a tank cover 13, a reinforcing board 14. The compression oil cylinder 2 may also be referred to as a hydraulic cylinder or as a pressurized fluid cylinder. The reinforcing board 14 may also be referred to as a reinforcing block, bar, rib, or strip. The tank wall 1 is provided on its left side with the compression oil cylinder 2, and the tank wall 1 is welded by rolled 15 mm thick steel plate, the compression oil cylinder 2 is provided on its lower side with the locking ring 3, the locking ring 3 is provided on its lower side with the spring cylinder 4, the tank wall 1 is provided on its right side with the locating pin mounting hole 5, the locating pin mounting hole 5 is provided thereon with the dowel pinhole 6, the tank wall 1 is provided therein with the refractory brick 7 and the guide mechanism 8, the tank wall 1 is provided at its upper end with the sealing structure 9 formed by a high temperature resistant silicone rubber sealing strip and is provided at its lower side with the arc joint 10, the arc joint 10 is connected with the arc shaped tank bottom 11, the arc joint 10 has a radian of R0.165 and the arc shaped tank bottom 11 has a radian of R2.565, the refractory brick 7 is provided thereon with the steel ladle stand 12, and the tank wall 1 is provided thereon with the tank cover 13, the tank cover 13 is consistent, in the structure basis, with the tank wall 1, and is further provided with 24 reinforcing boards 14.

The working principle of the gas pressure tank structure of the present utility model is described below. In the structure, the tank wall 1 is welded by rolled 15 mm thick steel plate and thus has a high strength to ensure that it will not deform at high temperature and under high pressure. The tank wall 1 is provided at its upper end with the sealing structure 9 and the sealing structure 9 is formed by a high temperature resistant silicone rubber sealing strip such that a good sealing between the pressure tank and tank cover 13 is provided to ensure that there is no gas leakage in pressure pouring. When the tank cover 13 is closed onto the pressure tank, the space between them and the steel ladle is relatively small, thus can reduce the consumption of compressed air and increase the response speed of the pouring pressure curve during pouring.

The tank cover 13 is further provided with 24 reinforcing boards 14 and has an even top structure on its top end to facilitate connection to the production line.

The embodiments described as above are example embodiments of the present invention and are set forth only for illustration of the present invention, rather than making limitation to the present invention in any form. Any equivalent embodiment with a partial variation or modification, which does not depart from the technical feature contents of the present invention, made by those skilled in the art based on the technical contents disclosed in the present invention and without departing from the scope of the technical features as provided in the present invention, will fall within the scope of the technical features of the present invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A gas pressure tank structure, comprising:

a tank wall (1), a compression oil cylinder (2), a locking ring (3), a spring cylinder (4), a locating pin mounting hole (5), a dowel pinhole (6), a refractory brick (7), a guide mechanism (8), a sealing structure (9), an arc joint (10), an arc shaped tank bottom (11), a steel ladle stand (12), a tank cover (13), and a reinforcing board (14);

wherein the tank wall (1) is provided on its left side with the compression oil cylinder (2), the compression oil cylinder (2) is provided on its lower side with the locking ring (3), the locking ring (3) is provided on its lower side with the spring cylinder (4), the tank wall (1) is provided on its right side with the locating pin mounting hole (5), the locating pin mounting hole (5) is provided thereon with the dowel pinhole (6), the tank wall (1) is provided therein with the refractory brick (7) and the guide mechanism (8), the tank wall (1) is provided at its upper end with the sealing structure (9) and is provided at its lower side with the arc joint (10), the arc joint (10) is connected with the arc shaped tank bottom (11), the refractory brick (7) is provided thereon with the steel ladle stand (12), and the tank wall (1) is provided thereon with the tank cover (13).

2. The gas pressure tank structure according to claim 1, wherein the tank wall (1) is welded by rolled 15 mm thick steel plate.

3. The gas pressure tank structure according to claim 1, wherein the sealing structure (9) is formed by a high temperature resistant silicone rubber sealing strip.

* * * * *